US005441108A

United States Patent [19]

Jenkins et al.

[11] Patent Number: 5,441,108

[45] Date of Patent: Aug. 15, 1995

[54] FLUID SPILL CATCHING, CONTAINING, COLLECTION AND RECOVERY SYSTEM FOR WELLHEADS

[75] Inventors: Michael E. Jenkins, Sour Lake; Charles A. Roberts, Hillister; Steven D. Stripling, Houston, all of Tex.

[73] Assignee: R.J.S., Inc., Katy, Tex.

[21] Appl. No.: 306,598

[22] Filed: Sep. 15, 1994

[51] Int. Cl.[6] ..... E21B 33/08

[52] U.S. Cl. ..... 166/53; 166/81; 166/93

[58] Field of Search ..... 166/53, 81, 93, 84, 166/379, 75.1; 277/17, 18, 19, 22; 405/52, 270

[56] References Cited

U.S. PATENT DOCUMENTS

| | | | |
|---|---|---|---|
| 4,665,976 | 5/1987 | Retherford | 166/81 |
| 4,949,784 | 8/1990 | Evans | 166/81 |
| 5,098,220 | 3/1992 | Norman | 166/81 X |
| 5,150,751 | 9/1992 | Burton et al. | 166/81 |
| 5,167,277 | 12/1992 | Evans | 166/81 |
| 5,211,244 | 5/1993 | Arterbury | 166/379 |
| 5,228,506 | 7/1993 | Pearce | 166/81 |
| 5,246,067 | 9/1993 | Heinoner et al. | 166/81 |
| 5,351,753 | 10/1994 | Golson | 166/81 |
| 5,377,748 | 1/1995 | Gayaut | 166/81 |
| 5,394,939 | 3/1995 | Walker | 166/84 X |

*Primary Examiner*—Stephen J. Novosad
*Attorney, Agent, or Firm*—Donald A. Kettlestrings

[57] ABSTRACT

A system for catching, containing and collecting fluids spilled from or adjacent to a wellhead and for recovering the fluids by automatically transporting the spilled fluids to the wellhead production flowline includes a deflector for attachment to the wellhead for directing downwardly fluids spilled or accidentally released from the wellhead, a containment area for catching and containing the spilled fluids, a container connected in fluid communication with the containment area for receiving spilled fluids drained from the containment area, and a pump connected in fluid communication between the container and the production flowline for-automatically transporting fluids from the container to the production flowline.

14 Claims, 7 Drawing Sheets

FLUID SPILL CATCHING, CONTAINING, COLLECTION AND RECOVERY SYSTEM FOR WELLHEADS

BACKGROUND OF THE INVENTION

This invention relates to a spill collection system for wellheads and more particularly to a fluid spill collection and recovery system which catches, contains and collects fluids spilled from or adjacent to a wellhead and which recovers the spilled fluids by automatically transporting the spilled fluids back to the wellhead production flowline.

Leakage and spillage of fluids, such as oil and salt water, are common occurrences during wellhead drilling and workover operations. Stuffing box failure can also occur which will allow fluids to escape from the wellhead, and the fluids will be sprayed in various directions. The leakage and spillage age of wellhead fluids can have devastating effects on the environment, and it is desirable to collect and contain such fluids at the wellhead to prevent environmental damage.

It is, therefore, an object of the present invention to provide a system for catching, containing and collecting fluids spilled from or adjacent to a Wellhead and for automatically transporting the spilled fluids to the wellhead production flowline.

Another object is to provide such a system which includes a fluid deflector for downwardly deflecting sprayed fluids discharged from the wellhead so that the discharged fluids are collected and automatically transported to the wellhead production flowline.

Another object is to provide such a system where the fluid deflector can be quickly and easily placed into proper position on the wellhead and which can be quickly and easily removed from the wellhead.

A further object of the invention is the provision of such a system which can be used during drilling and workover operations at the wellhead.

Still another object is to provide such a system which provides for supports within a containment area for supporting and storing wellhead piping not in use and for collecting fluids spilled from the wellhead piping within the containment area for automatic transportation to the wellhead production flowline.

A still further object of the invention is to provide such a system which provides a support within a containment area for supporting workover rigs or other machinery and for collecting fluids spilled from the workover rigs or other machinery within the containment area for automatic transportation to the wellhead production flowline.

Yet another object of the present invention is the provision of such a system which is a permanent installation with the wellhead and which requires no additional installation procedures when used with a workover rig.

Another object is to provide such a system which can be put into use from the time that the wellhead is installed until the time that the wellhead is plugged and abandoned.

Another object is to provide such a system which includes a fluid deflector that can be used with all types of wellhead stuffing boxes.

A still further object is to provide such a system which automatically returns all spilled fluids back to the production flowline and equipment to save money and to avoid loss of production.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a system for catching, containing and collecting fluids spilled from or adjacent to a wellhead and for recovering the spilled fluids by automatically transporting the spilled fluids to the wellhead production flowline, the system comprising: first means located around and beneath the wellhead defining a containment area for catching and containing the fluids; a wellhead production flowline connected in fluid communication with the wellhead for carrying fluid product from the wellhead to a product receiving location; a container; second means connected in fluid communication with the first means and with the container for draining the fluids from the first means into the container; and third means in operative relationship with the container and with the production flowline for automatically transporting the fluids from the container to the production flowline and to the product receiving location.

The invention further includes fluid deflection means in removable operative relationship with the wellhead and with the first means for deflecting fluids discharged from the wellhead downwardly onto the first means.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate an example of a preferred embodiment of the invention and, together with the description, serve to explain the principles of the invention.

DESCRIPTION OF THE PREFERRED EMBODIMENT

Figure 1:
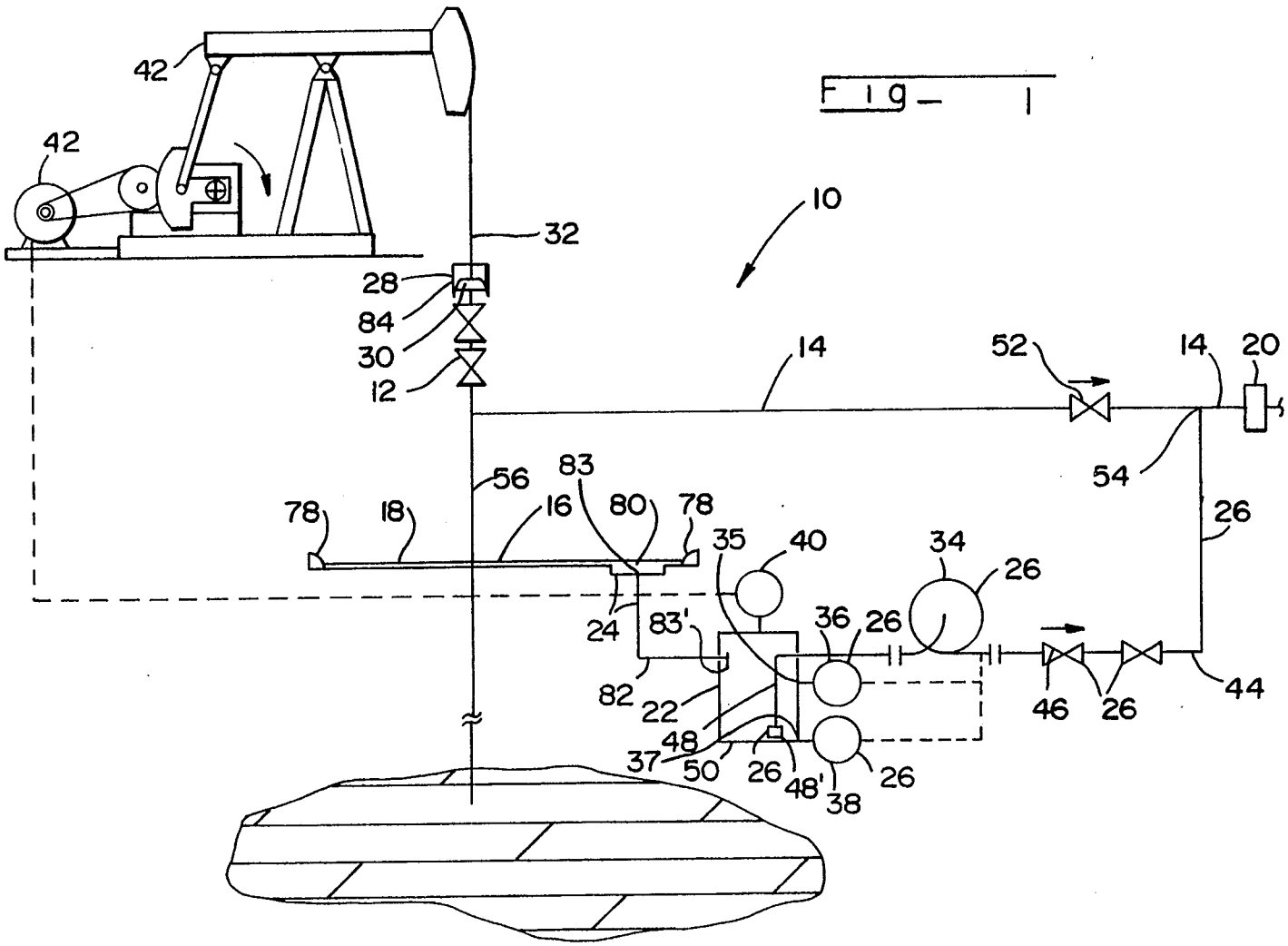
FIG. 1 is a diagrammatic view of the system of this invention.

With reference now to the drawings, wherein like reference characters designate like or corresponding parts throughout the several views, there is shown system 10 for catching, containing and collecting fluids spilled from or adjacent to wellhead 12 and for recovering the spilled fluids by automatically transporting the spilled fluids back to a wellhead production flowline 14. In accordance with the invention, system 10 includes first means generally designated as 16 located around and beneath wellhead 12 and defining a containment area 18 for catching and containing spilled fluids.

System 10 further includes a conventional wellhead production flowline 14 connected in a conventional manner in fluid communication with wellhead 12 for carrying fluid product, such as oil mixed with salt water and other fluids, from wellhead 12 to a product receiving location 20. Product receiving location 20 can be a conventional separator which separates the oil from the salt water and other fluids.

Containment area 18 is typically at ground level, and production flowline 14 is typically located above ground level. System 10 also includes a container 22, which is typically buried underground, and second means 24 are connected in fluid communication with first means 16, with containment area 18 and with container 22 for draining fluids from first means 16 and from containment area 18 into container 22.

In accordance with the invention, system 10 further includes third means generally designated as 26 in operative relationship with container 22 and with production flowline 14 for automatically transporting fluids from container 22 to production flowline 14 and on to product receiving location 20.

System 10 further preferably includes fluid deflection means 28 in removable operative relationship with wellhead 12, with first means 16 and with containment area 18 for deflecting fluids accidentally discharged or sprayed from wellhead 12 downwardly onto first means 16 and into containment area 18. A conventional stuffing box 30 is provided at wellhead 12, and the conventional stuffing box typically contains a packing gland (not shown) through which a polished, pump rod 32 reciprocates in fluid-tight relationship. Stuffing box 30 prevents the escape of fluid past polished rod 32 and diverts it into production flowline 14. The packing of the stuffing box is subject to wear, and if the packing wears excessively, the fluid-tight seal with rod 32 will be broken to permit fluids to escape and to be sprayed in various directions from the wellhead. Deflection means 28 is positioned above and around stuffing box 30 for downwardly deflecting fluids accidentally discharged from wellhead 12 in the event of such a failure of stuffing box 30.

In accordance with the invention, third means generally designated at 26 include a pump 34 typically located above ground level and supported on the ground by a metal skid (not shown). Pump 34 is typically located as closely as possible to wellhead 12, and the location of pump 34 is also determined by the physical location of wellhead 12. Pump 34 is connected in fluid communication between container 22 and production flowline 14.

First switch means 36 are provided in operative relationship with container 22 and with pump 34 for activating the pump to transport fluids from container 22 to production flowline 14 when the fluids reach a first predetermined level within container 22. System 10 further includes second switch means 38 in operative relationship with container 22 and with pump 34 for deactivating the pump when fluids reach a second predetermined level within container 22.

Third switch means 40 are also provided in operative relationship with container 22 and with conventional wellhead pumping unit 42 for deactivating pumping unit 42 when fluids reach a third predetermined level within container 22. This is an overflow protection and safety mechanism so that pumping unit 42 will be deactivated when the fluid level in container 22 reaches a dangerously high level.

Third means generally designated at 26 further include first piping 44 connected in fluid communication between pump 34 and production flowline 14. Third means 26 also include first valve means 46 connected in fluid communication with piping 44 and between pump 34 and production flowline 14 which permits fluid flow in only one direction through piping 44 from pump 34 to production flowline 14.

Third means 26 further include second piping 48 connected in fluid communication between container 22 and pump 34. Second piping 48 defines a first end 48' positioned adjacent to a lower portion 50 of container 22 and at a location at the second predetermined level within container 22.

Second valve means 52 are connected in fluid communication with production flowline 14 and between wellhead 12 and a connection 54 of first piping 44 to production flowline 14. Second valve means 52 permits flow of fluid product in only one direction through production flowline 14 from wellhead 12 to product receiving location 20.

Wellhead 12 includes conventional wellhead piping 56 which extends downwardly into the ground and which projects upwardly above ground level from within containment area 18. In accordance with the invention, first means 16 include an excavation 58 within the ground beneath and coextensive with containment area 18. Excavation 58 typically defines a floor 60 and sidewalls 62 which extend between floor 60 and ground level 64.

A first sheet 66 of oil-resistant material, such as high density polyethylene, is positioned within excavation 58 covering floor 60 and covering sidewalls 62. Sheet 66 surrounds wellhead piping 56 and is connected to piping 56 by conventional mechanical clamping (not shown) and/or by use of a resin and catalytic bonder.

First means 16 further include a plurality of supports 68, 70 and 72 which are located within excavation 58 and which are positioned between first sheet 66 and ground level 64. Supports 68–72 may be constructed of reinforced concrete or of granular stabilized fill material consisting of recycled concrete which has been reduced to a consistency of gravel. Alternatively, supports 68–72 may be constructed of stabilized sand consisting of cement and sand or on site material which has been removed from the ground in the process of digging excavation 58. Materials other than reinforced concrete will be compacted to form stabilized supports. Support 68 is typically sixteen feet long by three feet wide by three feet deep to accommodate and support workover rigs. Supports 70, 72 may typically be four feet long by four feet wide by three feet deep to accommodate and support on end tubing pulled from the well.

First means 16 further include fill material 74 located within excavation 58 between supports 68, 70 and 72 and positioned on sheet 66 and between sheet 66 and ground level 64.

A second sheet 76 of oil-resistant material, such as high density polyethylene, is positioned coextensively with containment area 18 and at ground level 64 to cover supports 68–72 and fill material 74. Second sheet 76 surrounds wellhead piping 56 and is connected to piping 56 by mechanical clamping (not shown) and/or by use of a resin with a catalytic bonder.

Curbing 78 is provided at ground level 64, and curbing 78 surrounds containment area 18 to confine spilled fluids within containment area 18. Sheets 66, 76 are connected to curbing 78 by bonding the sheets to the curbing using a resin and a catalytic bonder.

Second means 24 include a drainage trough 80 formed by second sheet 76 within a depression formed in fill material 74 for receiving spilled fluids from sheet 76, and second means 24 also include third piping 82 connected in fluid communication between trough 80 and container 22 for draining the spilled fluids from trough 80 into container 22.

Fluid deflection means 28 include a deflector 84 which defines a cylindrical sidewall 86, a circular endwall 88 connected to side wall 86 and a circular open end 90 opposed to endwall 88. Sidewall 86 can be other than cylindrical in shape, but the cylindrical shape is preferred. Deflector 84 is preferably constructed of stainless steel with welded joints.

Sidewall 86 defines two opposed circular openings 92, 92' therein, and endwall 88 defines a circular hole 94 therein. The centers of openings 92, 92' and of hole 94 are in coplanar alignment with each other.

Figure 6:
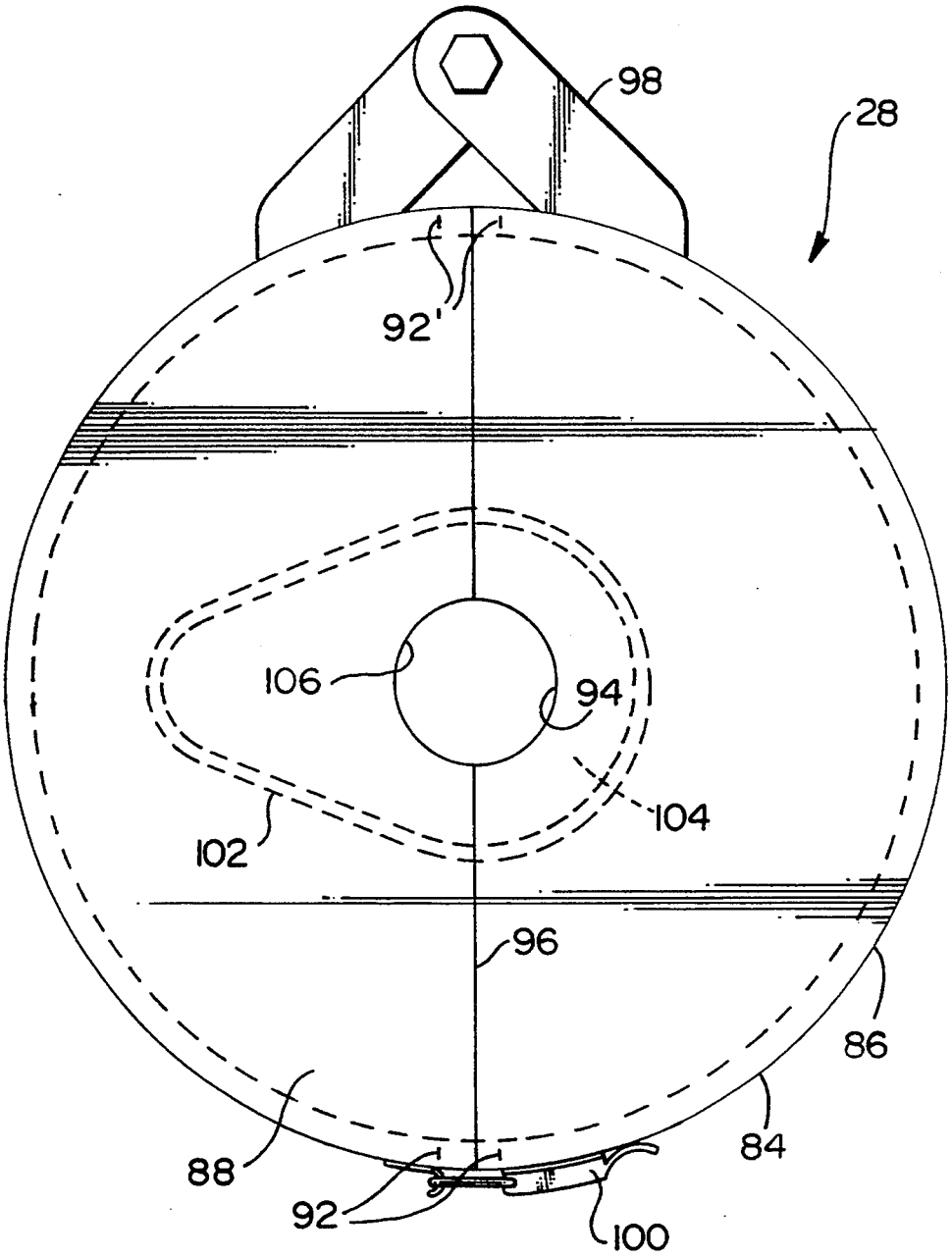
FIG. 6 is a top plan view of the fluid deflection means portion of the system in a closed position.
Figure 7:
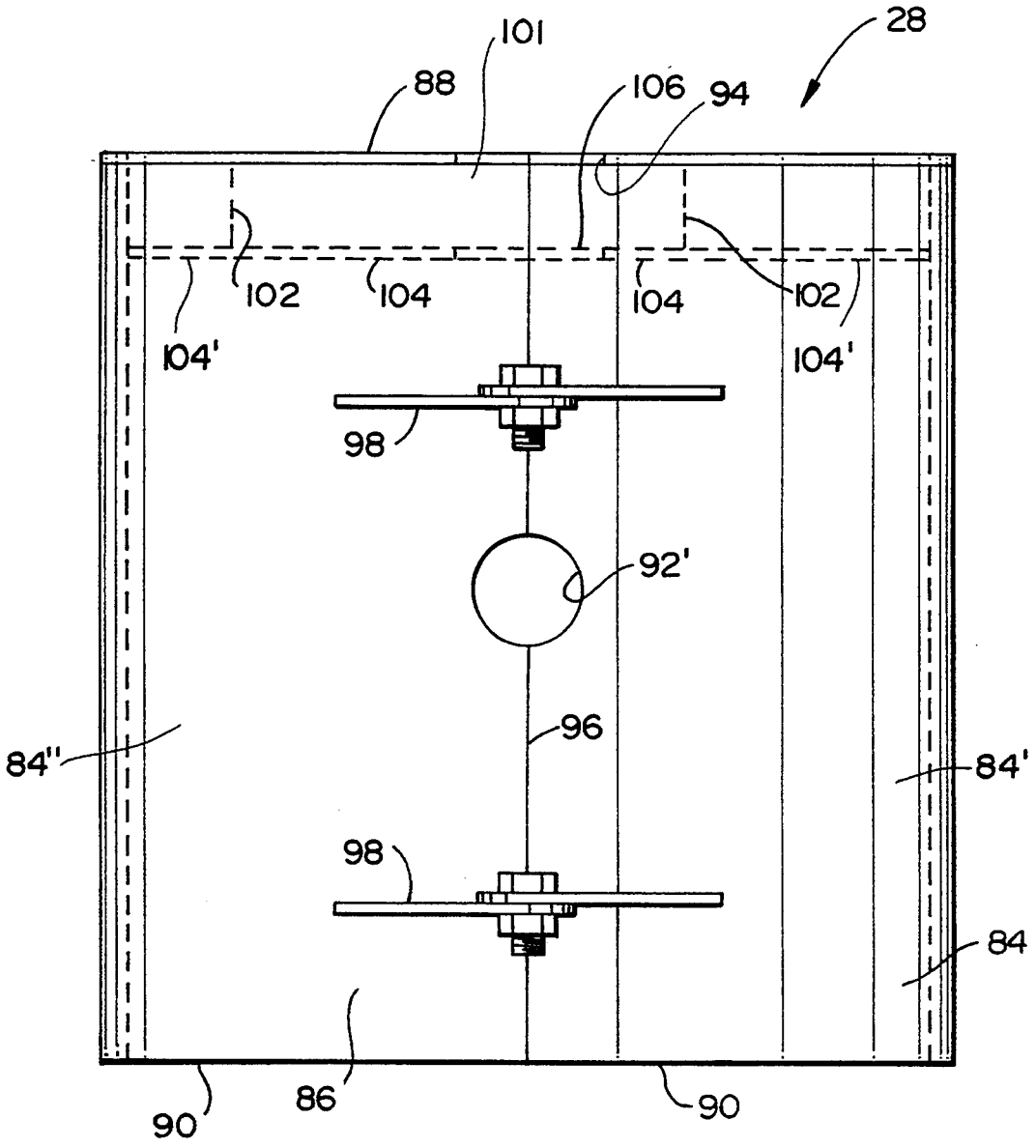
FIG. 7 is a rear elevation view of the deflection means in a closed position.
Figure 8:
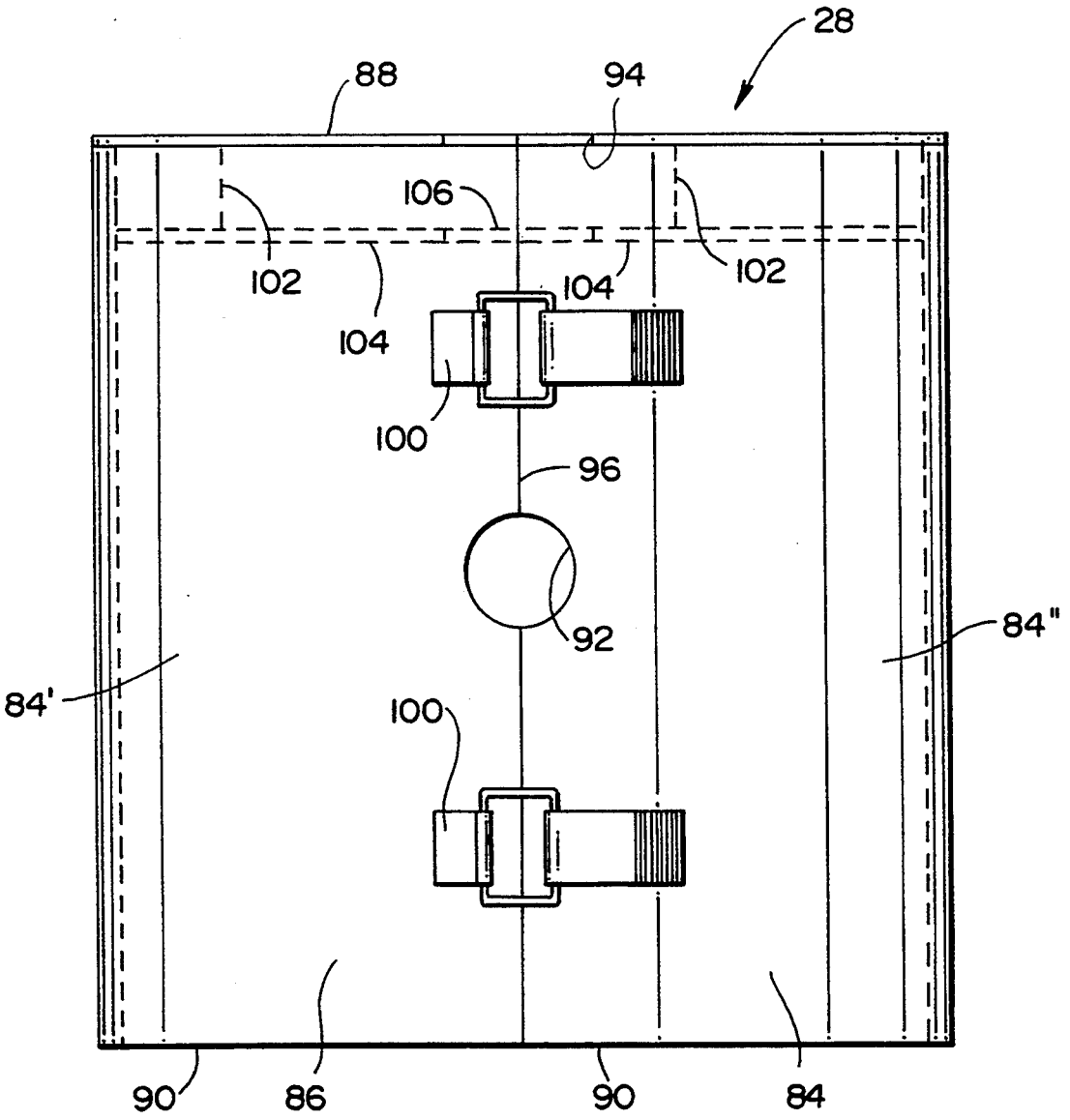
FIG. 8 is a front elevation view of the deflection means in a closed position.

Deflector 84 is divided into two separate half-sections 84', 84" along an imaginary plane 96 which passes through the centers of openings 92, 92' and hole 94. Hinges 98 are connected to sidewall 86 for enabling relative movement of sections 84' , 84" between closed and opened positions with respect to each other FIGS. 6–8 illustrate sections 84', 84" in the closed position with respect to each other. Means 100 are connected to sidewall 86 opposite to hinges 98 for holding and locking sections 84', 84" in the closed position with respect to each other.

Deflector 84 also includes a compartment sidewall 102 connected perpendicularly to endwall 88. Sidewall 102 surrounds hole 94 and projects downwardly into the interior of deflector 84 from endwall 88 a predetermined distance toward open end 90. A compartment end wall 104 is connected to compartment sidewall 102 and defines a circular aperture 106 therein, the center of aperture 106 being within imaginary plane 96. Portion 104' of endwall 104 connects between sidewall 102 and sidewall 86 to provide strength and rigidity to deflector 84. Compartment sidewall 102 is divided into two separate sections along imaginary plane 96 so that the compartment formed by endwall 88, sidewall 102 and endwall 104 will enclose stuffing box 30 (FIG. 1), and deflector 84 will be supported by and suspended from the stuffing box as endwall 88 rests on top of the stuffing box. Sidewall 102 is preferably substantially oval in configuration (see FIG. 6) to conform to the configuration of the pack-off rubber and the stuffing box. The stuffing box and pack-off rubber are conventional and are not illustrated in detail, but the pack-off rubber defines a circular opening for receiving polished, pump rod 32 in a conventional manner.

In operation and use, excavation 58 is dug around wellhead piping 56 and beneath wellhead 12. Care must be taken not to damage piping 56 during the excavation process. The excavation is preferably about three feet deep, and first sheet 66 of high density polyethylene or other appropriate environmental lining material is positioned within the excavation and substantially against excavation floor 60 and excavation sidewalls 62. Sheet 66 is also positioned around wellhead piping 56, and sheet 66 is attached to wellhead piping 56 in a fluid-tight manner by use of conventional mechanical clamps (not shown) or by adhesively attaching sheet 66 to piping 56 with a conventional resin with a catalytic bonder.

Supports 68, 70 and 72 are then formed in position within excavation 58 and on top of first sheet 66. The material used for supports 68–72 depends upon the depth of the well. Deeper wells may require the use of reinforced concrete, or granular stabilized fill consisting of recycled concrete which has been reduced to a consistency of gravel can be used. Alternatively, stabilized sand consisting of cement and sand can be used, or material from the site which has been removed from the excavation may also be used. Any loose materials will be compacted to form stabilized supports 168–72.

Figure 2:
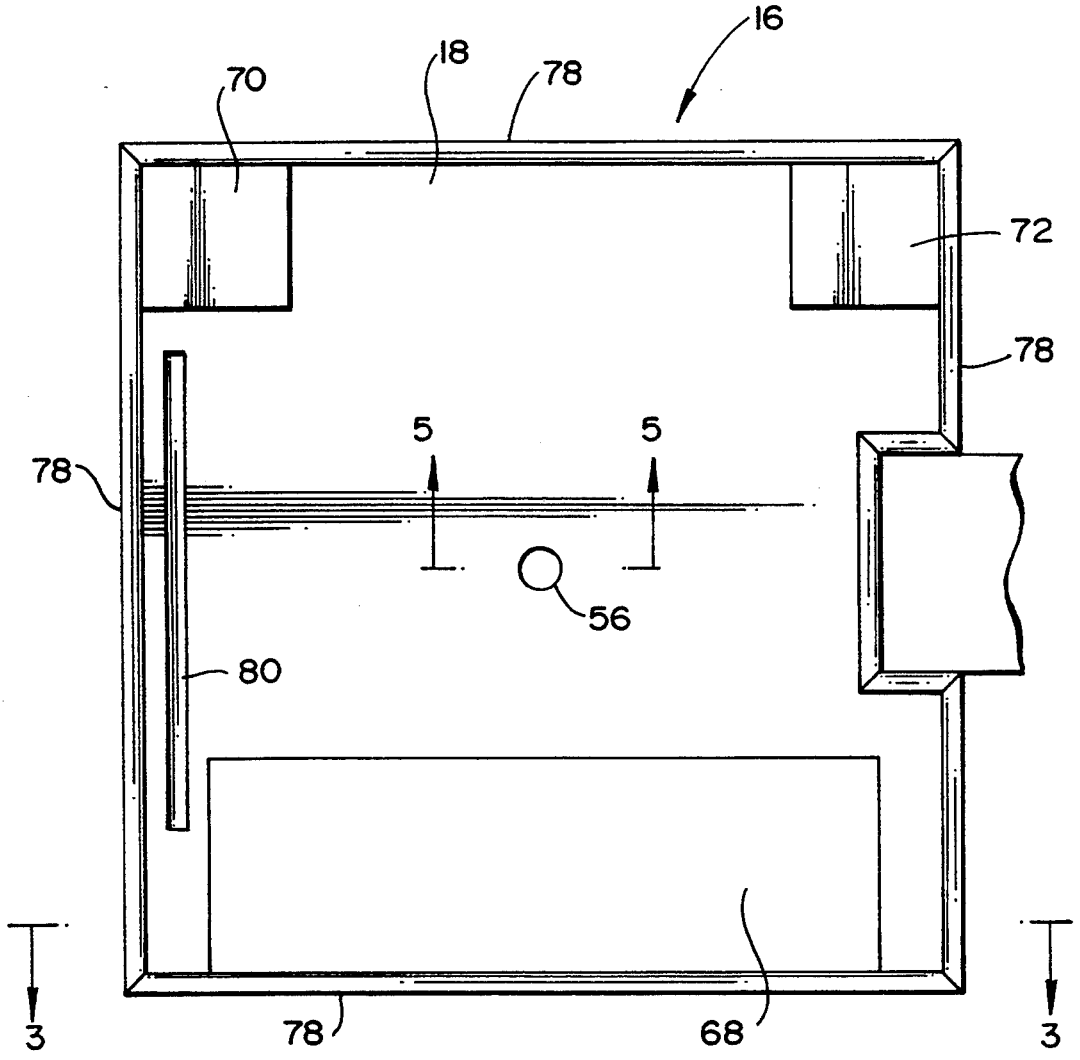
FIG. 2 is a top plan view showing the containment area around a wellhead for catching and containing spilled fluids.
Figure 3:
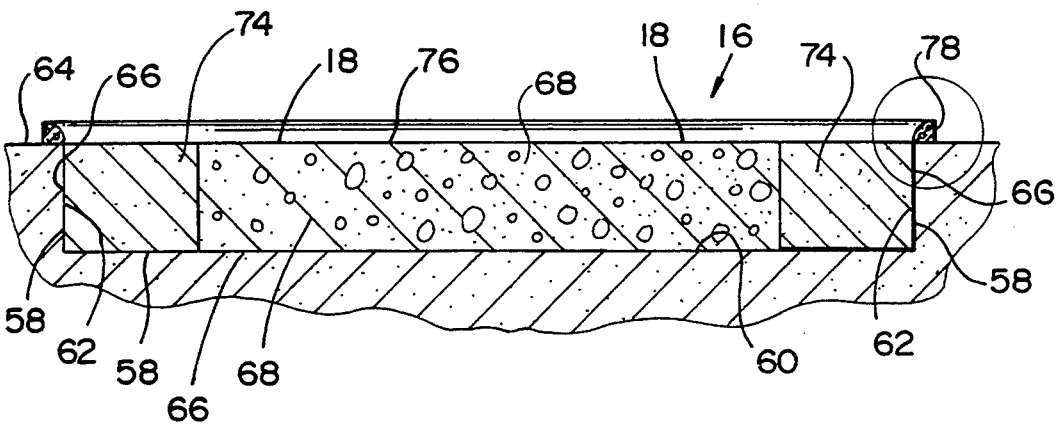
FIG. 3 is a cross-sectional view taken along the line 3—3 in FIG. 2 and looking in the direction of the arrows.
Figure 4:
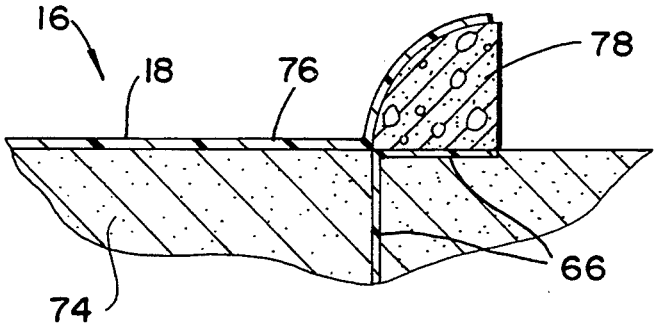
FIG. 4 is an enlarged fragmentary detailed view of a portion of the containment area shown in FIG. 3.
Figure 5:
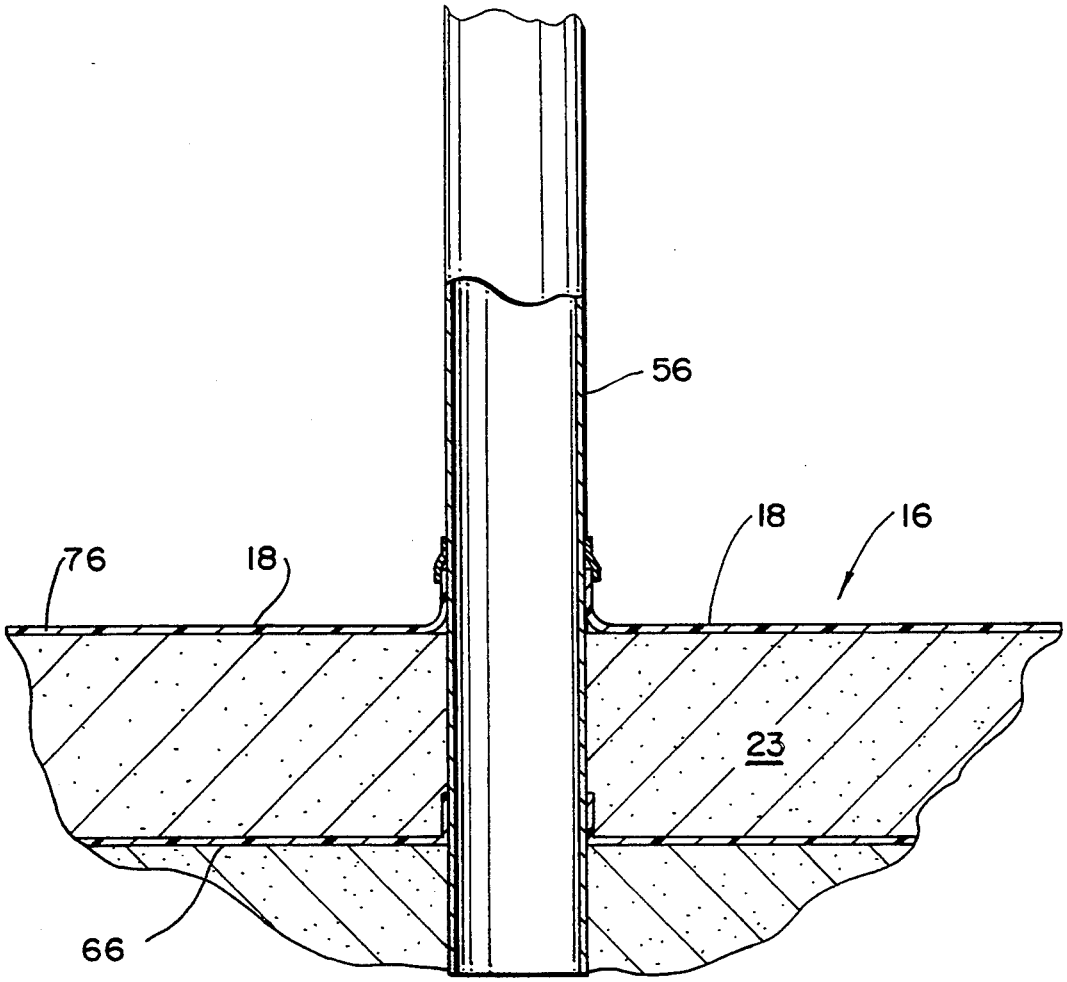
FIG. 5 is a fragmentary cross-sectional view taken along the line 5—5 in FIG. 2 and looking in the direction of the arrows.

Support 68 is intended to support a workover rig, and supports 70, 72 are designed to support tubing pulled from the well. Support 68 is preferably sixteen feet long by three feet wide by three feet deep. Each of supports 70, 72 is preferably four feet long by four feet wide by three feet deep. The relative locations of supports 68–72 are best seen in FIG. 2, but it should be understood that the relative positions of supports 68–72 with respect to each other can be different from that shown in FIG. 2 depending upon the particular wellhead site configuration and location.

After supports 68–72 have been formed, the areas between the supports are filled by replacing material excavated from excavation 58. The depth of the fill material 74 and the depths of supports 68–72 are such that a substantially level surface is created at substantially ground level 64. A trench or trough 80, however, is formed within fill material 74, and third, drainage piping 82 is positioned within fill material 74 with an upper end in fluid communication with trough 80 and with a lower end 83' positioned within container 22, which is located beneath ground level 64.

Second sheet or environmental liner 76 is then positioned on top of fill material 74 and on top of supports 68–72. Sheet 76 is also positioned around wellhead piping 56 and is connected to wellhead piping 56 by conventional mechanical clamps (not shown) or by conventional use of a resin with a catalytic bonder.

Curbing 78, preferably made of concrete, is preformed in separate sections and is set in place around containment area 18. Corners of curbing 78 and joints between pre-formed sections of curbing 78 are joined together with steel reinforcing, and cementicious material is put into place in cooperation with the steel reinforcing to form a monolithic curbing which completely surrounds containment area 18. Sheets 66 and 76 are each bonded to curbing 78 by using a conventional resin with a catalytic bonder.

Pump 34 is located above ground level 64, and pump 34 is preferably supported on a metal skid or skids (not shown). Piping 48 is positioned within container 22 with a first or lower end 48' of piping 48 located adjacent a bottom portion 50 of container 22. Piping 48 is connected in fluid communication with pump 34, and piping 44 is connected at 54 above ground level 64 to wellhead production flowline 14.

Deflector 84 is positioned on and around wellhead 12 by unlocking locks 100 and by rotating deflector sections 84', 84'' to open positions with respect to each other about hinges 98. Deflector 84 is then positioned over wellhead 12 with conventional wellhead stuffing box 30 positioned within compartment 101 formed by compartment sidewall 102 and by endwalls 88,104. Wellhead piping 56 extends through hole 94 and through aperture 106 in deflector 84, and other wellhead piping (not shown) is positioned within openings 92, 92' of deflector 84.

When deflector 84 has been positioned as previously described, deflector 84 will be supported by the conventional stuffing box of wellhead 12, and locks 100 are locked into position to firmly hold deflector 84 in position. In the event of failure at wellhead 12 which results in spraying of oil and/or other fluids from the wellhead, deflector 84 will deflect the sprayed fluids downwardly onto sheet 76 within containment area 18. Because compartment sidewall 102 and endwalls 88,104 of deflector 84 enclose the conventional stuffing box, the forces of the sprayed oil or other fluids acting against the interior surfaces of deflector 84 will not dislodge the deflector from its proper position.

Any other oil or other fluids which may leak from wellhead 12 and any fluids which may leak from workover rigs or other machinery positioned within and above containment area 18 are collected within containment area 18. The collected oil and other fluids within containment area 18 flow into drainage trough 80 and through piping 82 into container 22. The oil and other fluids are collected and stored within container 22, and when the level of fluids within container 22 reaches a first predetermined level 35, switch 36 acts to activate pump 34. The oil and other fluids within container 22 are then transferred by the pumping action of pump 34 from within container 22 through valves 46, 47 and through piping 44 to connection 54 with wellhead production flowline 14. The oil and other fluids are prevented from travelling back to wellhead piping 56 by valve 52, and the oil and other fluids are transported from connection 54 to a conventional separator or other product receiving location 20.

When the level of fluids within container 22 reaches a second predetermined level 37, switch 38 acts to stop the pumping action of pump 34.

If switch 36 becomes inoperative, third switch 40 will act to stop pumping unit 42. As a result, no further oil or other fluids will be produced from the well, and container 22 will not be permitted to overflow to contaminate the area. Each of switches 36, 38 and 40 are conventional fluid-level sensing switches.

Valves 46, 52 are conventional check valves which permit fluid flow in only one direction, and valve 47 is a conventional gate valve.

This invention provides a system for catching, containing and collecting fluids spilled from or adjacent to a wellhead and for recovering the spilled fluids by automatically transporting the spilled fluids to a wellhead production flowline.

The invention in its broader aspects is not limited to the specific details shown and described, and departures may be made from such details without departing from the principles of the invention and without sacrificing its chief advantages.

What is claimed is:

1. A system for catching, containing and collecting fluids spilled from and/or adjacent to a wellhead and for recovering the spilled fluids by automatically transporting the spilled fluids to a wellhead production flowline, said system comprising:

first means located around and beneath said wellhead defining a containment area for catching and containing said fluids;

a wellhead production flowline connected in fluid communication with said wellhead for carrying fluid product from said wellhead to a product receiving location;

a container;

second means connected in fluid communication with said first means and with said container for draining said fluids from said first means into said container; and third means in operative relationship with said container and with said production flowline for automatically transporting said fluids from said container to said production flowline and to said product receiving location.

2. A system as in claim 1 further including fluid deflection means in removable operative relationship with said wellhead and with said first means for deflecting fluid discharged from said wellhead downwardly onto said first means.

3. A system as in claim 2 wherein said third means include:

a pump connected in fluid communication between said container and said production flowline;

first switch means in operative relationship with said container and with said pump for activating said pump to transport said fluids from said container to said production flowline when said fluids reach a first predetermined level within said container; and second switch means in operative relationship with said container and with said pump for deactivating said pump when said fluids reach a second predetermined level within said container.

4. A system as in claim 3 in combination with a conventional wellhead pumping unit, said system further including:

third switch means in operative relationship with said container and with said wellhead pumping unit for deactivating said wellhead pumping unit when said fluids reach a third predetermined level within said container.

5. A system as in claim 3 wherein said third means further include:

first piping connected in fluid communication between said pump and said production flowline; and first valve means connected in fluid communication with said piping and between said pump and said production flowline for permitting fluid flow in only one direction through said piping from said pump to said production flowline.

6. A system as in claim 5 wherein said third means further include:

second piping connected in fluid communication between said container and said pump, said second piping defining a first end positioned adjacent to a lower portion of said container and substantially at a location at said second predetermined level within said container.

7. A system as in claim 6 further including:

second valve means connected in fluid communication with said production flowline and between said wellhead and the connection of said first piping to said production flowline for permitting flow of said fluid product in only one direction through said production flowline from said wellhead to said product receiving location.

8. A system as in claim 2 wherein said wellhead includes wellhead piping extending downwardly into the ground and projecting upwardly above ground level from within said containment area, said first means including:

an excavation within the ground beneath and substantially coextensive with said containment area, said excavation defining a floor and sidewalls extending between said floor and ground level;

a first sheet of oil-resistant material positioned within said excavation substantially covering said floor and said sidewalls, surrounding said wellhead piping and connected to said wellhead piping;

a plurality of supports within said excavation positioned between said first sheet and substantially ground level;

fill material within said excavation between said supports and positioned between said first sheet and substantially ground level;

a second sheet of oil-resistant material coextensive with said containment area at substantially ground level covering said supports and said fill material, surrounding said wellhead piping and connected to said wellhead piping; and curbing at substantially ground level surrounding said containment area to confine said spilled fluids within said containment area, said first sheet and said second sheet connected to said curbing.

9. A system as in claim 8 wherein said second means include a drainage trough in operative relationship with said second sheet for receiving said spilled fluids from said second sheet and wherein said second means further include third piping connected in fluid communication between said trough and said container for draining said spilled fluids from said trough into said container.

10. A system as in claim 9 wherein a first one of said supports is configured for supporting a workover rig.

11. A system as in claim 9 wherein at least a second one of said supports is configured for supporting and storing wellhead piping not in use.

12. A system as in claim 2 wherein said fluid deflection means include:

a deflector defining a substantially cylindrical sidewall, a substantially circular endwall connected to said sidewall and a substantially circular open end opposed to said endwall;

said sidewall defining two opposed substantially circular openings therein and said endwall defining a substantially circular hole therein, centers of said openings and said hole being in substantially coplanar alignment with each other;

said deflector divided into two separate sections along an imaginary plane passing substantially through said centers of said openings and said hole;

hinge means connected to said sidewall for enabling relative movement of said sections between closed and opened positions with respect to each other; and means connected to said sidewall for holding and locking said sections in closed position with respect to each other.

13. A system as in claim 12 further including:

a compartment sidewall connected to said endwall, surrounding said hole and projecting from said endwall a predetermined distance into said deflector and toward said circular open end of said deflector;

a compartment endwall connected to said compartment sidewall and defining a substantially circular aperture therein, the center of said aperture being substantially within said imaginary plane; and said compartment sidewall being divided into two separate sections along said imaginary plane.

14. A system as in claim 13 wherein said compartment sidewall is substantially oval in configuration.

* * * * *